US010167763B2

(12) United States Patent
Baxendale

(10) Patent No.: US 10,167,763 B2
(45) Date of Patent: Jan. 1, 2019

(54) FLUID FLOW ADJUSTMENT DOOR WITH PIVOTABLE INNER DOOR

(71) Applicant: Ford Global Technologies, LLC, Dearborn, MI (US)

(72) Inventor: Timothy Baxendale, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 133 days.

(21) Appl. No.: 15/252,022

(22) Filed: Aug. 30, 2016

(65) Prior Publication Data

US 2018/0058299 A1 Mar. 1, 2018

(51) Int. Cl.
*F01N 13/08* (2010.01)
*F01N 3/08* (2006.01)

(52) U.S. Cl.
CPC ..... *F01N 13/08* (2013.01); *F01N 3/08* (2013.01); *F01N 2240/02* (2013.01); *F01N 2240/36* (2013.01); *F01N 2390/00* (2013.01)

(58) Field of Classification Search
CPC .. F01N 2390/00; F01N 13/08; F01N 2240/02; F01N 2240/36; F01N 3/08
USPC ..... 60/324
See application file for complete search history.

(56) References Cited

U.S. PATENT DOCUMENTS

| | | | | |
|---|---|---|---|---|
| 4,909,442 | A | 3/1990 | Fernz | |
| 5,182,905 | A | 2/1993 | Stransky et al. | |
| 5,255,850 | A | 10/1993 | Cockerham | |
| 6,010,547 | A * | 1/2000 | Jeong | F01N 3/023 55/282.3 |
| 6,916,286 | B2 | 7/2005 | Kazakevich | |
| 7,588,047 | B2 | 9/2009 | Vogt | |
| 7,921,828 | B2 | 4/2011 | Knafl et al. | |
| 8,387,385 | B2 | 3/2013 | Gray, Jr. et al. | |
| 2010/0206515 | A1 * | 8/2010 | Sun | H05K 7/2019 165/72 |

* cited by examiner

*Primary Examiner* — Phutthiwat Wongwian
*Assistant Examiner* — Kelsey Stanek
(74) *Attorney, Agent, or Firm* — Julia Voutyras; McCoy Russell LLP

(57) ABSTRACT

Methods and systems are provided for a door of an exhaust system of an engine. In one example, a door of an exhaust system may include an outer door pivotable around a first location and an inner door pivotable around a second location, with the inner door positioned within the outer door, and with an amount of opening of an aperture of the outer door adjustable by a position of the inner door.

18 Claims, 10 Drawing Sheets

FLUID FLOW ADJUSTMENT DOOR WITH PIVOTABLE INNER DOOR

FIELD

The present description relates generally to methods and systems for a door of a fluid flow system.

BACKGROUND/SUMMARY

A fluid flow system, such as an engine exhaust system, often includes multiple fluid passages configured to direct fluids from a fluid source to a fluid flow outlet. Some fluid passages may also be configured to direct fluids (e.g., gases) toward one or more components or systems coupled to the fluid flow system. In the example of the engine exhaust system, exhaust gas may be directed to an exhaust gas heat recovery (EGHR) system. The EGHR system may include a heat exchanger configured to receive hot exhaust gases from a first exhaust passage, and to return cooled exhaust gases to the exhaust system through a second exhaust passage. The first exhaust passage may form a junction with a bypass passage configured to flow gases past the heat exchanger, and a device configured to control a direction of exhaust gas flow may be positioned within the junction. In some examples, the device may include one or more apertures configured to open or close in order to increase or decrease an amount of gas flowing through the device, thereby adjusting a flow rate of gases through the exhaust system and to the heat exchanger.

Other attempts to address adjusting a flow rate of gases through a fluid flow system include utilizing a plurality of flow control doors. One example approach is shown by Knafl et al. in U.S. Pat. No. 7,921,828. Therein, a heat exchanger of a motor vehicle is disclosed, with the heat exchanger including a plurality of flow control doors adjustable by a control system. The control system may increase or decrease an amount of opening of each flow control door to control an amount of gas flowing into the heat exchanger.

However, the inventors herein have recognized potential issues with such systems. As one example, gas flowing into a heat exchanger (such as that described above) may increase an amount of gas backpressure at an inlet of the heat exchanger beyond an acceptable amount of backpressure for engine operation. In order to reduce gas backpressure, a flow rate of gas into the heat exchanger may be decreased while a flow rate of gas through a bypass passage around the heat exchanger may be increased (in one example, by adjusting an amount of opening of the flow control doors described above). However, when backpressure and/or flow rate is sufficiently high, an amount of force to adjust the opening of the flow control doors may exceed a maximum amount that an actuator of the flow control doors can produce. In other words, the actuator of the flow control doors may not be able to adjust the amount of opening of the flow control doors as a result of the backpressure, and the flow control doors may become stuck in their positions, thereby reducing an amount of control of the control system over the gas flow through the heat exchanger. As a result, engine performance may be decreased.

In one example, the issues described above may be addressed by a method for a door for a fluid flow system, comprising: a pivotable outer door coupled to a fluid passage at a first pivot location; and an inner door positioned within the outer door and pivotable relative to the outer door, with the inner door coupled to the outer door at a second pivot location. In this way, the outer door may pivot in a first direction while the inner door may pivot independently of the outer door in a second direction.

As one example, the door may be positioned at a junction between a bypass fluid passage and an active fluid passage. The door may pivot from a first location corresponding to a bypass position, to a second location corresponding to an active position. In the bypass position, the position of the door may increase a flow of fluid through the bypass fluid passage reduce a flow of fluid through the active fluid passage. In the active position, the door may increase the flow of fluid through the active fluid passage, and decrease the flow of fluid through the bypass fluid passage. If a pressure difference between a first fluid pressure at a first side of the door and a second fluid pressure at a second side of the door exceeds a threshold difference, the inner door may pivot relative to the outer door to increase a flow of fluid through an aperture of the outer door.

In this way, when the pressure difference exceeds the threshold difference while the door is in the active position, the inner door may pivot to direct fluid away from the active fluid passage and into the bypass passage by increasing an amount of opening of the aperture of the outer door, thereby reducing the pressure difference. By reducing the pressure difference, an actuator of the door may then move the door from the active position to the bypass position with reduced effort, thereby reducing a likelihood of the door becoming stuck in the active position. As a result, a reliability of the door is increased, and a door actuator with a smaller size and/or cost may be utilized.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-10 are shown approximately to scale, though other relative dimensions may be used.

DETAILED DESCRIPTION

The following description relates to systems and methods for a door for a fluid flow system, such as an exhaust system of an engine. An engine system, such as the engine system shown by FIG. 1, may include an exhaust system, with the exhaust system including a heat exchanger, a plurality of exhaust passages, and a pivotable door coupled within a junction of the exhaust passages. The door, such as the door shown by FIG. 2, includes an inner door and an outer door, with the inner door pivotable relative to the outer door. The inner door may be coupled to the outer door at a first location by a pivot pin, and may couple to the outer door at a second location with a detent shaped to couple with a ball of the outer door, as shown by FIGS. 3A-3B. The door may be pivoted from a bypass position (shown by FIG. 4) to an active position (shown by FIG. 6), with a pin of the inner door sliding along a groove of an exhaust passage while the door is in a position between the bypass position and the active position (shown by FIG. 5). When a difference in pressure between a first fluid pressure at a first side of the door and a second fluid pressure at a second side of the door exceeds a threshold difference, the detent of the inner door may decouple from the ball of the outer door such that the inner door pivots relative to the outer door, as shown by FIG. 7. The inner door may pivot until it reaches a fully opened position relative to the outer door, as shown by FIG. 8, and is perpendicular relative to the outer door. An actuator of the door may then pivot the door (as shown by FIG. 9) back to the bypass position (shown by FIG. 10), with the detent of the inner door coupling with the ball of the outer door when the door returns to the bypass position.

Figure 1:
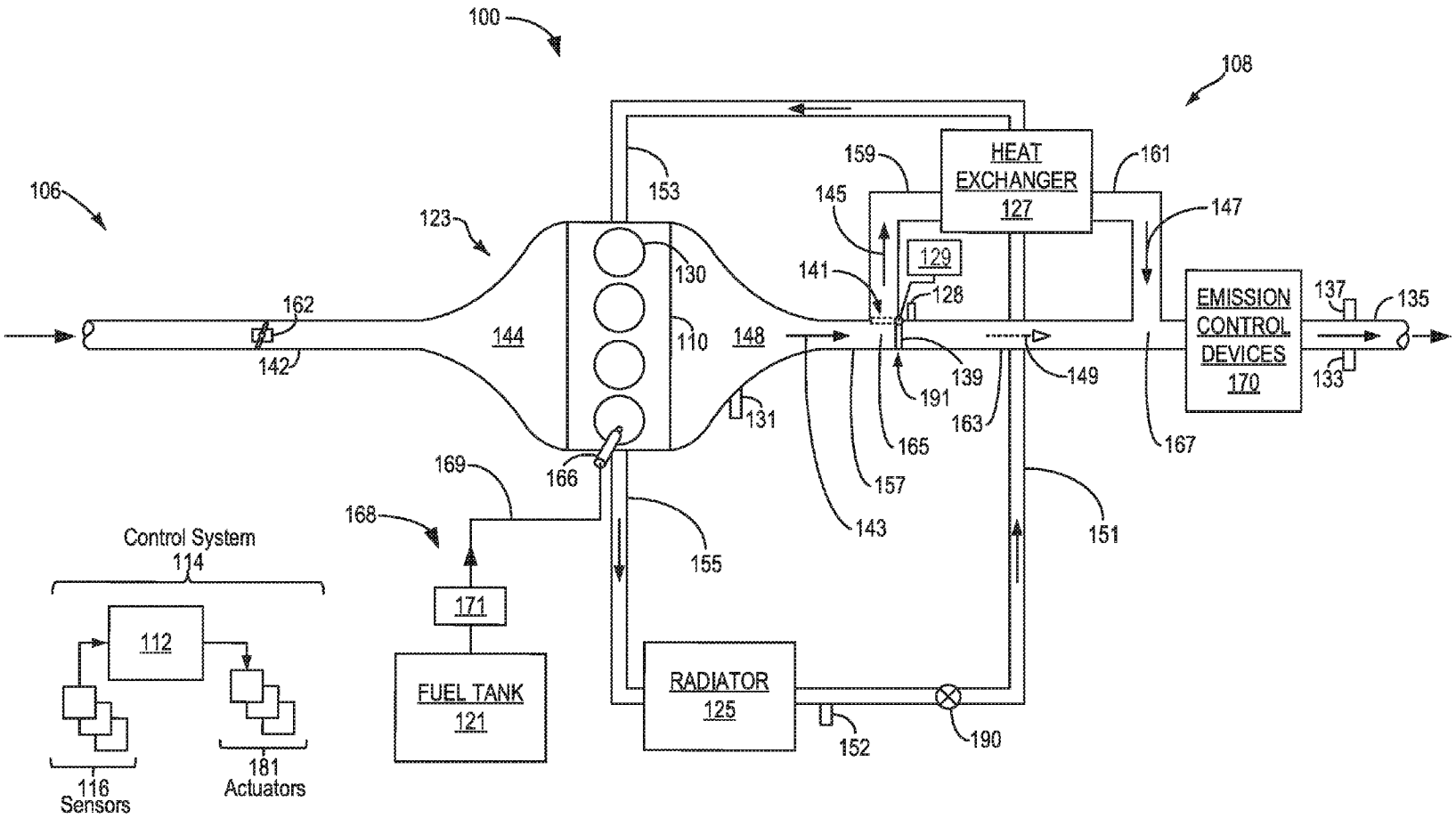
FIG. 1 shows an engine system including an exhaust system, with a door positioned within the exhaust system.

Turning now to FIG. 1, a schematic depiction of a fluid flow system 108 is shown, with the fluid flow system 108 (which may herein be referred to as exhaust system 108) included within an engine system 100. The engine system 100 includes an engine 123, an intake system 106, and the exhaust system 108. The engine 123 may include a plurality of cylinders 130 coupled with cylinder head 110. The intake system 106 includes a throttle 162 fluidly coupled to the engine intake manifold 144 via an intake passage 142. The exhaust system 108 includes an exhaust manifold 148 leading to an exhaust passage 135 that routes exhaust gas to the atmosphere. The exhaust system 108 may include one or more emission control devices 170, which may be mounted in a close-coupled position in the exhaust system 108. The one or more emission control devices 170 may include a three-way catalyst, lean NOx trap, diesel particulate filter, oxidation catalyst, etc. It will be appreciated that other components may be included in the engine such as a variety of valves and sensors.

The engine system 100 also includes a fuel system 168 which may include a fuel tank 121 coupled to a fuel pump system 171. The fuel pump system 171 may include one or more pumps for pressurizing fuel delivered to fuel injectors of engine 123 through fuel line 169, such as the example injector 166 shown. While only a single injector 166 is shown, additional injectors are provided for each cylinder. It will be appreciated that fuel system 168 may be a return-less fuel system, a return fuel system, or various other types of fuel system.

Engine 123 may be configured to receive coolant from a coolant source, such as radiator 125. In one example, radiator 125 may deliver coolant through a coolant passage 151 towards a heat exchanger 127. A flow of coolant through coolant passage 151 may be adjusted by actuation of valve 190 coupled to coolant passage 151. Heat exchanger 127 is coupled to an active exhaust passage 159 and a return exhaust passage 161 within the exhaust system 108. Heat exchanger 127 may receive coolant from coolant passage 151 at a first temperature, and transfer thermal energy from exhaust gas flowing through the heat exchanger 127 to the coolant. The coolant may then exit the heat exchanger 127 at a second temperature through a second coolant passage 153, with the second temperature being greater than the first temperature. In some examples, exhaust gas may not be flowing through the heat exchanger 127 (e.g., when the exhaust gas is instead directed into bypass passage 163). When exhaust gas is not flowing through the heat exchanger 127, coolant may instead enter the heat exchanger 127 at the first temperature and exit the heat exchanger at approximately a same temperature as the first temperature. In other examples, the coolant passage 151 may be coupled to a coolant bypass passage configured to flow coolant directly from the radiator 125 to the engine 123 and not through heat exchanger 127. Coolant may return to radiator 125 from the engine 123 through coolant passage 155.

As described above, heat exchanger 127 is coupled with the active exhaust passage 159 and return exhaust passage 161. An exhaust flow 143 from exhaust manifold 148 may flow through exhaust passage 157 towards first junction 165. Door 139 is coupled within the first junction 165 and may be actuated by a door actuator 129 to pivot the door 139 from a bypass position 141 to an active position 191 (e.g., approximately perpendicular with the bypass position 141), from the active position 191 to the bypass position 141, or to a plurality of positions between the bypass position 141 and the active position 191. As one example, the door actuator 129 may be an electrical actuator, such as a stepper motor or solenoid configured to pivot the door 139 in response to an electric signal from control system 114. In other examples, the actuator may be a mechanical actuator, such as a rack and pinion. Alternate embodiments may include alternate actuators not described here.

When the door 139 is in the active position 191, exhaust flow 143 from exhaust manifold 148 may be directed into active exhaust passage 159 towards heat exchanger 127 as indicated by exhaust flow 145. In other words, the exhaust flow 143 from exhaust manifold 148 into active exhaust passage 159 may increase when the door 139 is in the active position 191, while a flow of exhaust gas into bypass passage 163 may decrease. The exhaust flow 145 travels through heat exchanger 127 and flows into return exhaust passage 161 as exhaust flow 147, where the exhaust flow 147 then flows into second junction 167 and travels toward emission control devices 170.

When the door 139 is in the bypass position 141, exhaust flow 143 from exhaust manifold 148 may instead be directed into bypass passage 163 as exhaust flow 149. The exhaust flow 149 flows through bypass passage 163 toward emissions control devices 170 and does not flow toward heat exchanger 127. In other words, by positioning the door 139 in the bypass position 141, exhaust flow 145 toward heat exchanger 127 is decreased, while exhaust flow 149 through bypass passage 163 is increased. Position sensor 128 may transmit a signal to controller 112 of the control system 114 indicating a position of the door 139.

Engine 123 may be controlled at least partially by a control system 114 including controller 112 and by input from a vehicle operator via an input device (not shown). Control system 114 is configured to receive information from a plurality of sensors 116 (various examples of which are described herein) and sending control signals to a plurality of actuators 181. As one example, sensors 116 may include position sensor 128 coupled to bypass passage 163, manifold air pressure (MAP) sensor 131 coupled to exhaust manifold 148, temperature sensor 137 coupled to exhaust passage 135, flow rate sensor 133 coupled to exhaust passage 135, and coolant temperature sensor 152 coupled to coolant passage 151. Various exhaust gas sensors may also be included in exhaust system 108, within and/or downstream of exhaust manifold 148, such as particulate matter (PM) sensors, temperature sensors, pressure sensors, NOx sensors, oxygen sensors, ammonia sensors, hydrocarbon sensors, etc. Other sensors such as additional pressure, temperature, air/fuel ratio and composition sensors may be coupled to various locations in the engine system 100. As another example, actuators 181 may include fuel injector 166, valve 190 coupled to coolant passage 151, intake throttle 162, fuel pumps of fuel pump system 171, and door actuator 129. Other actuators, such as a variety of additional valves and throttles, may be coupled to various locations in engine system 100. Controller 112 may receive input data from the various sensors, process the input data, and trigger the actuators in response to the processed input data based on instruction or code programmed therein corresponding to one or more routines.

Controller 112 may be a microcomputer, and may include a microprocessor unit, input/output ports, an electronic storage medium for executable programs and calibration values such as a read only memory chip, random access memory, keep alive memory, and/or a data bus. Controller 112 may receive various signals from sensors coupled to engine 123, in addition to those signals previously discussed, including measurement of inducted mass air flow (MAF) from a mass air flow sensor; engine coolant temperature (ECT) from a temperature sensor coupled to a cooling sleeve; a profile ignition pickup signal (PIP) from a Hall effect sensor (or other type) coupled to a crankshaft; throttle position (TP) from a throttle position sensor; absolute manifold pressure signal (MAP) from one or more intake and exhaust manifold sensors, cylinder air/fuel ratio from an exhaust gas oxygen sensor, and abnormal combustion from a knock sensor and a crankshaft acceleration sensor. Engine speed signal, RPM, may be generated by controller 112 from signal PIP. Manifold pressure signal MAP from a manifold pressure sensor may be used to provide an indication of vacuum, or pressure, in the intake manifold.

The controller 112 receives signals from the various sensors of FIG. 1 and employs the various actuators of FIG. 1 to adjust engine operation based on the received signals and instructions stored on a memory of the controller. In one example, the controller adjusts the position of the door 139 based on a flow rate of exhaust gas through the exhaust system. For example, the controller may determine a control signal to send to the door actuator 129, such as a pulse width of the signal (with the pulse width corresponding to an amount of adjustment of the position of the door 139) being determined based on a determination of the flow rate of exhaust gas. The exhaust flow rate may be based on a measured exhaust flow rate, or determined based on operating conditions such as engine torque output, fuel consumption, etc. The controller may determine the pulse width through a determination that directly takes into account a determined exhaust flow rate, such as increasing the pulse width with increasing exhaust flow rate. The controller may alternatively determine the pulse width based on a calculation using a look-up table with the input being exhaust flow rate and the output being pulse-width.

As another example, the controller may make a logical determination (e.g., regarding a position of door 139) based on logic rules that are a function of exhaust gas flow rate. The controller may then generate a control signal that is sent to door actuator 129. For example, adjusting a position of the door 139 may include energizing the door actuator 129 to pivot the door 139 from the bypass position to the active position, or from the active position to the bypass position, as shown by FIGS. 4-10 and described below. It should be appreciated that while fluid flow system 108 is depicted by FIG. 1 as the exhaust system of engine system 100, the fluid flow system may be a different type of fluid flow system, such as a heating, ventilation, and air conditioning (HVAC) system. In each embodiment, the fluid flow system includes a pivotable door, such as door 139 described above, or door 200 described below (and shown by FIGS. 2-10).

Figure 2:
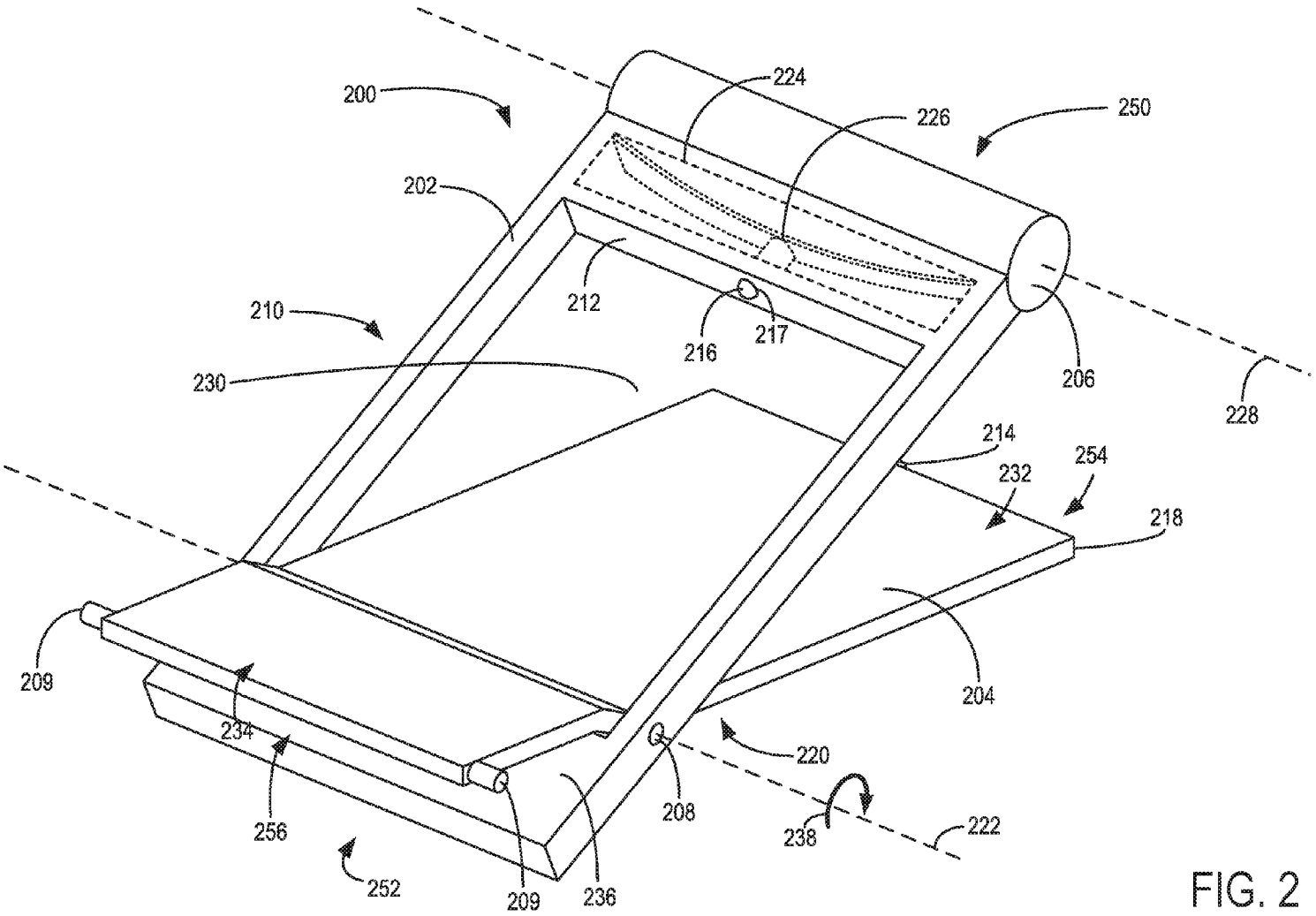
FIG. 2 shows a perspective view of an example door including a ball coupled to an outer door and a detent coupled to an inner door.
Figure 3B:
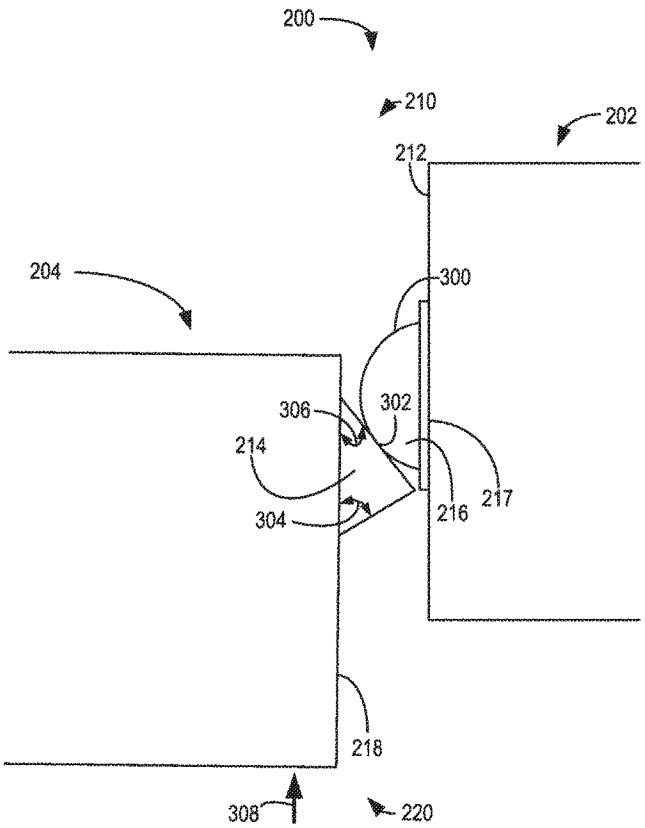
FIGS. 3A-3B show a side view of the ball and detent of the door, with FIG. 3A showing the detent coupled with the ball, and FIG. 3B showing the detent decoupled from the ball.
Figure 3A:
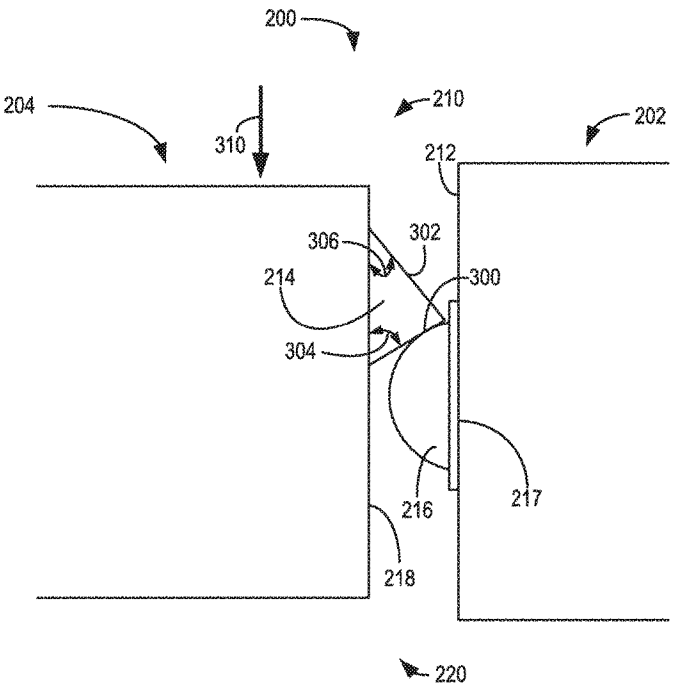

FIG. 2 shows a perspective view of a door 200, similar to the door 139 shown by FIG. 1, which may be included within a fluid flow system (such as the exhaust system 108 of the engine system 100 shown by FIG. 1). The door includes a first side 210 and a second side 220, with the first side 210 and second side 220 defined relative to a position of an outer door 202 as shown by FIG. 2. The door also includes an inner door 204 positioned within the outer door 202. A first end 250 of the outer door 202 is coupled to a location within an exhaust system (such as the first junction 165 of exhaust system 108 shown by FIG. 1) by a first pivot pin 206, and is pivotable relative to the coupled location (e.g., the first pivot location) around a first pivot axis 228 positioned parallel with a longest length of the first pivot pin 206. The inner door 204 is coupled to the outer door 202 by a second pivot pin 208 at a second pivot location, and the inner door 204 is pivotable relative to the outer door 202 around a second pivot axis 222 positioned parallel to a longest length of the second pivot pin 208. The second pivot pin 208 is positioned between the first end 250 of the outer door 202 and a second end 252 of the outer door 202, and may be positioned closer to the second end 252 than the first end 250. The inner door 204 includes a first portion 232 and a second portion 234. The first portion 232 is configured to fit within an aperture 230 of the outer door 202 and may pivot through the aperture 230. The second portion 234 is configured to be in face-sharing contact with an outer surface 236 of the outer door 202 when the inner door 204 is positioned approximately parallel to the outer door 202.

The inner door 204 includes a detent 214 formed by an end surface 218 of the inner door 204 at a first end 254 of the inner door 204, and the outer door 202 includes a ball 216 coupled to an inner surface 212 of the outer door 202. The ball 216 and detent 214 are shaped such that when the inner door 204 is positioned approximately parallel with the outer door 202, the detent 214 is coupled with the ball 216 (as shown by FIG. 3A and described below). By coupling the detent 214 with the ball 216, the inner door 204 may be retained in the position approximately parallel with the outer door 202, with the second portion 234 of the inner door 204 in face-sharing contact with the outer surface 236 of the outer door 202.

The ball 216 is coupled to a biasing member 226 positioned within an interior of the outer door 202, as indicated by partial interior view 224. In the example shown by FIG. 2, the biasing member 226 includes a shaft and leaf spring configured to urge the ball 216 through an opening 217 formed by the inner surface 212 of the outer door 202. The ball 216 may have an outer diameter such that a first portion of the ball 216 extends through the opening 217 due to the urging of the biasing member 226 against the ball 216, but a second portion of the ball 216 is retained within the interior of the outer door 202. In alternate embodiments, the ball 216 may be urged by a different biasing member, such as a coiled spring, solenoid, etc. Additionally, alternate embodiments may not include the ball 216 and detent 214 shown by FIG. 2, but may instead include a latch, hook, etc. configured to retain the inner door 204 in a position approximately parallel with the outer door 202, and to release the inner door 204 from its position when a sufficient amount of force is applied to the inner door 204, as described below with reference to FIGS. 3A-3B.

By configuring the inner door 204 and outer door 202 in this way, the inner door 204 may pivot relative to the outer door 202 such that the first portion 232 of the inner door 204 pivots in a first direction 238 around second pivot axis 222, or in a second direction opposite to the first direction. However, because the second portion 234 of the inner door 204 is configured to be in face-sharing contact with the outer surface 236 of the outer door 202 when the inner door 204 is positioned approximately parallel with the outer door 202, the second portion 234 may prevent the inner door 204 from pivoting in the second direction when the inner door 204 is positioned approximately parallel with the outer door 202. In other words, the first portion 232 of the inner door 204 may pivot from a position approximately parallel with the outer door 202 in the first direction 238, but may not pivot from the position approximately parallel with the outer door 202 in the second direction opposite to the first direction 238 due to the second portion 234 being in contact with the outer surface 236.

The inner door 204 may include a guide pin 209 positioned at a second end 256 of the inner door 204 and coupled to the second portion 234, away from the first portion 232. The guide pin 209 may be positioned parallel with the second pivot pin 208 and may be shaped to couple with a groove (shown by FIGS. 4-10) formed within the junction of the exhaust system (e.g., first junction 165 of exhaust system 108 shown by FIG. 1). The guide pin 209 may slide within the groove as the outer door 202 pivots relative to the coupled location within the exhaust system (e.g., relative to the first junction 165 shown by FIG. 1). The guide pin 209 may also slide within the groove as the inner door 204 pivots relative to the outer door 202. In one example, the groove may be shaped to retain the inner door 204 in a position approximately perpendicular with the outer door 202 as the outer door 202 pivots from an active position to a bypass position, as described below with reference to FIGS. 4-10.

Turning now to FIGS. 3A-3B, a side view of the ball 216 and detent 214 is shown, with the inner door 204 positioned approximately parallel with the outer door 202 in FIG. 3A, and with the inner door 204 pivoted relative to the outer door 202 in FIG. 3B. In the example shown by FIG. 3A, the ball 216 is coupled with the detent 214 to retain the inner door 204 in the position approximately parallel with the outer door 202, while in the example shown by FIG. 3B, the ball 216 is decoupled from the detent 214 so that the inner door 204 may pivot.

The detent 214 is formed by the end surface 218 of the inner door 204, and extends away from the end surface 218. The detent 214 includes a first angled surface 300 and a second angled surface 302, with the first angled surface 300 joined to the second angled surface 302, and each of the first angled surface 300 and second angled surface 302 joined to the end surface 218. The first angled surface 300 is angled relative to the end surface 218 by a first angle 304, and the second angled surface 302 is angled relative to the end surface 218 by a second angle 306. In one example, the first angle 304 may be greater than the second angle 306 such that the first angled surface 300 is angled by a greater amount, relative to the end surface 218, than the second angled surface 302.

By angling the first angled surface 300 by a greater amount (e.g., a larger angle relative to the end surface 218) than the second angled surface 302, a force applied to the inner door 204 to couple the ball 216 with the detent 214 may be less than a force applied to the inner door 204 to de-couple the ball 216 from the detent 214. For example, a coupling force 308 is represented by FIG. 3B as an arrow with a first length, and a decoupling force 310 is represented by FIG. 3A as an arrow with a second length, with the second length being greater than the first length (e.g., with a magnitude of decoupling force 310 being greater than a magnitude of coupling force 308). In one example, the decoupling force 310 may be due to a fluid pressure difference between the first side 210 and the second side 220. In other words, in the example shown by FIG. 3A, a pressure (e.g., gas pressure) at the first side 210 may be greater than a pressure at the second side 220, resulting in the decoupling force 310 against the inner door 204. The decoupling force 310 may press the inner door 204 in a direction away from the outer door 202 such that the detent 214 decouples with the ball 216 by pressing the first angled surface 300 against the ball 216 until the ball 216 retracts into the interior of the outer door 202. The inner door 204 (and detent 214) may then pivot relative to the outer door 202 into a position in which the ball 216 is not in face-sharing contact with the detent 214.

In another example, as shown by FIG. 3B, the inner door 204 is in a pivoted position relative to the outer door 202, and the coupling force 308 presses the inner door 204 in the direction of the outer door 202. In one example, the coupling force 308 may be a result of a force of a door actuator (such as the door actuator 129 shown by FIG. 1 and described above) against the outer door 202. In other words, the door actuator may pivot the outer door 202 into the bypass position (as described above with reference to FIG. 1), and as the outer door 202 pivots toward the bypass position, the guide pin 209 (shown by FIG. 2 and described above) of the inner door 204 may slide along a groove 402 (shown by FIGS. 4-10) to adjust a position of the inner door 204 relative to the outer door 202. As the outer door 202 reaches the bypass position as a result of actuation by the door actuator, the position of the inner door 204 is adjusted by the guide pin 209 such that the second angled surface 302 of the detent 214 of the inner door 204 is pressed against the ball 216 of the outer door 202 with the coupling force 308. The coupling force 308 presses the second angled surface 302 of the detent 214 against the ball 216 until the ball 216 retracts into the interior of the outer door 202, and the detent 214 and inner door 204 pivot into the position shown by FIG. 3A (e.g., the position in which the detent 214 is coupled with the ball 216).

As described above, the detent 214 and ball 216 may be configured such that the coupling force 308 is less than the decoupling force 310. In other words, by configuring the first angled surface 300 to be angled relative to the end surface 218 by a greater amount than the second angled surface 302 is angled relative to the end surface 218, a force to couple the detent 214 with the ball 216 (e.g., the coupling force 308) may be less than a force to decouple the detent 214 from the ball 216 (e.g., the decoupling force 310). In this way, the detent 214 may decouple from the ball 216 passively (e.g., automatically, without a signal from a control system such as control system 114 shown by FIG. 1) in response to a pressure difference between the first side 210 and the second side 220. Additionally, due to the second angle 306 between the second angled surface 302 and the end surface 218, the detent 214 may couple with the ball 216 more easily (e.g., with less force) compared to an embodiment in which both of the first angle 304 and second angle 306 are approximately the same. By configuring the second angle 306 and second angled surface 302 in this way, a door actuator with a smaller size and/or decreased cost may be used to pivot the outer door 202.

Figure 4:
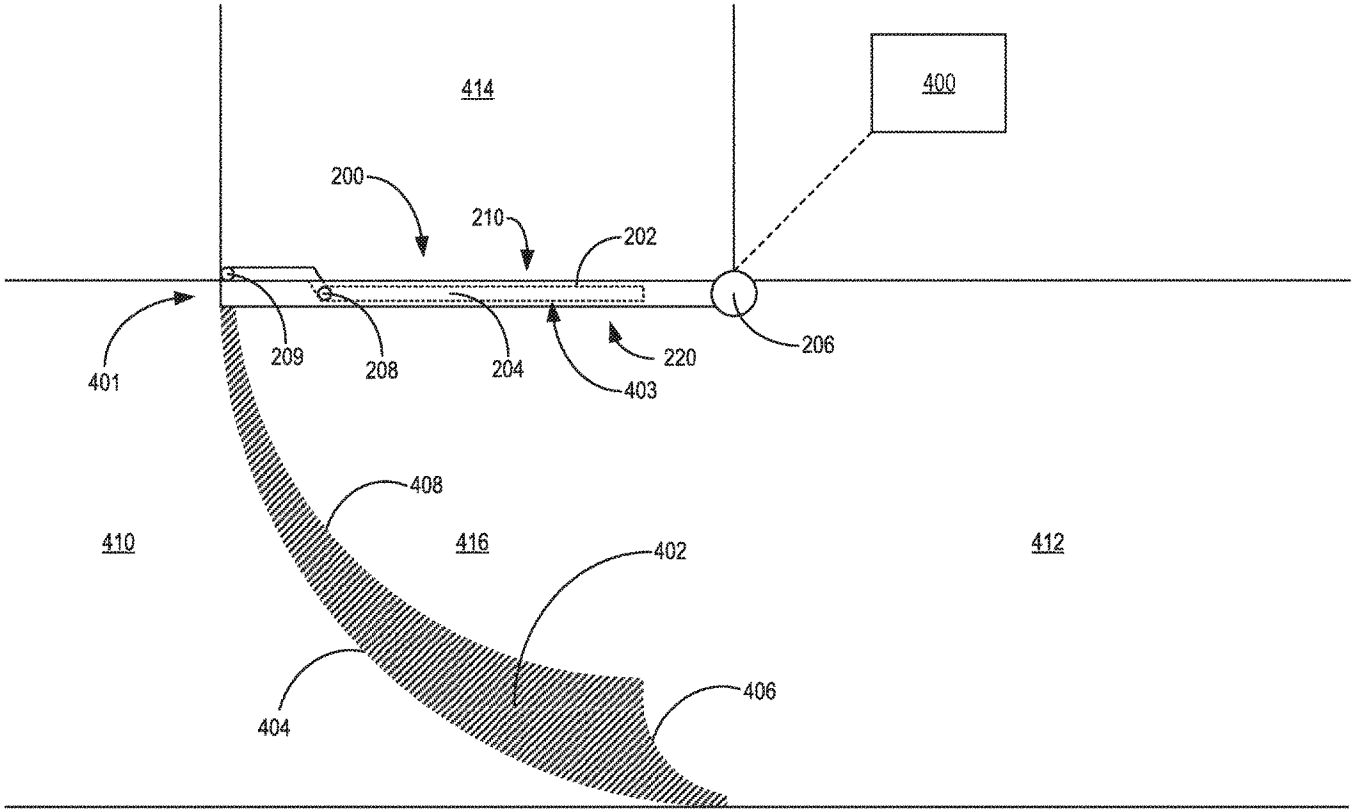
FIG. 4 shows a side view of the door coupled to an exhaust junction of an exhaust system, with the door in a bypass position.
Figure 5:
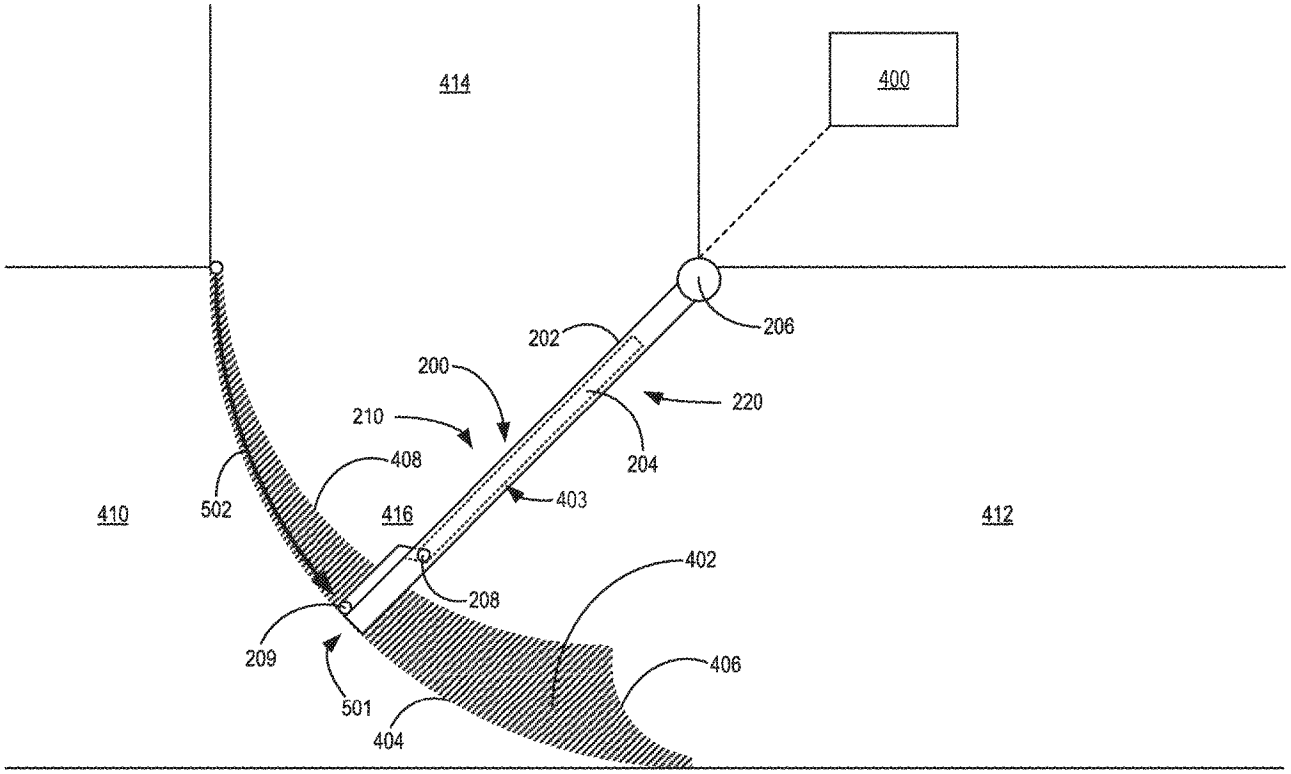
FIG. 5 shows a side view of the door in a position between the bypass position and an active position.
Figure 6:
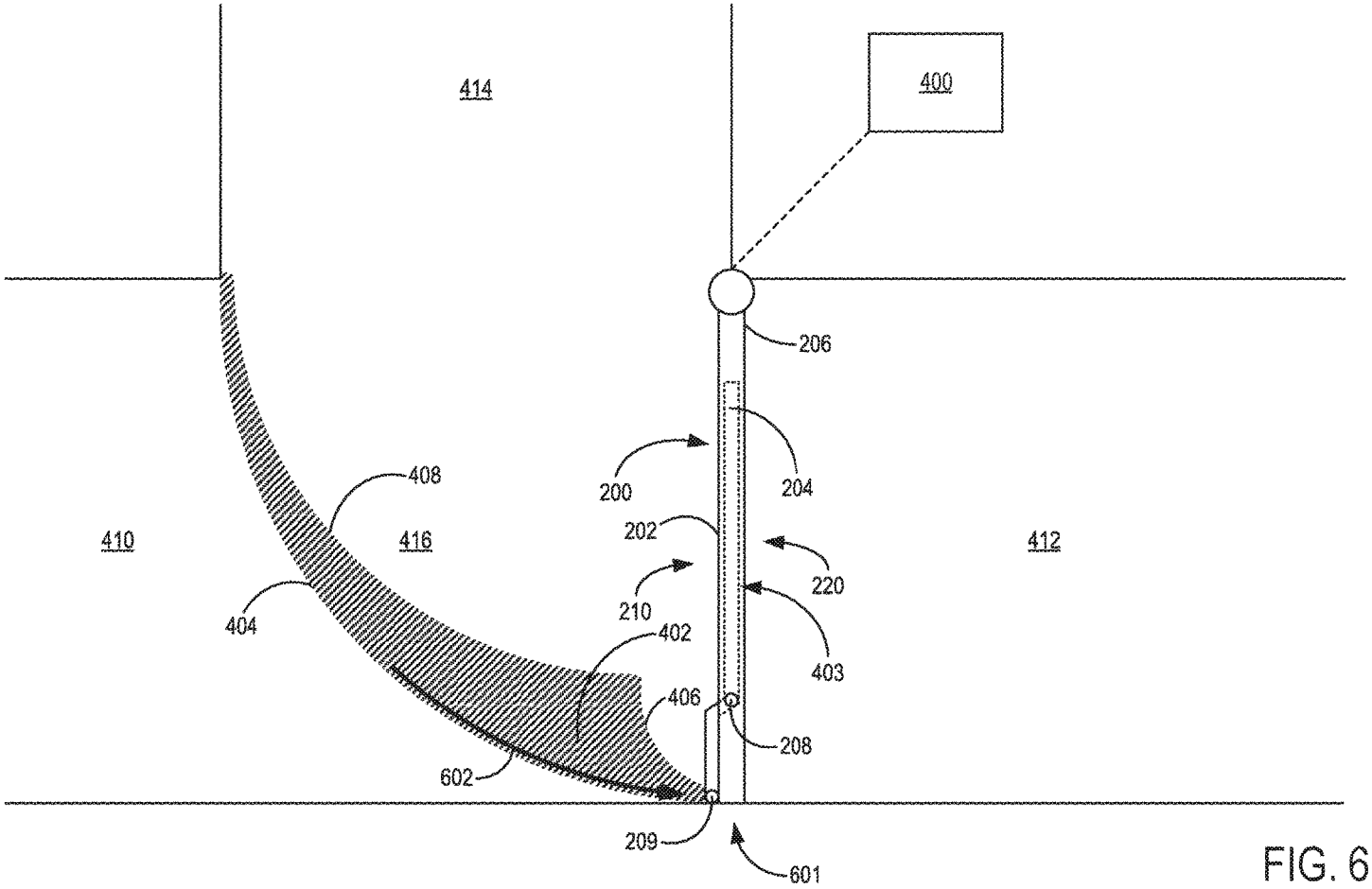
FIG. 6 shows a side view of the door in the active position.
Figure 7:
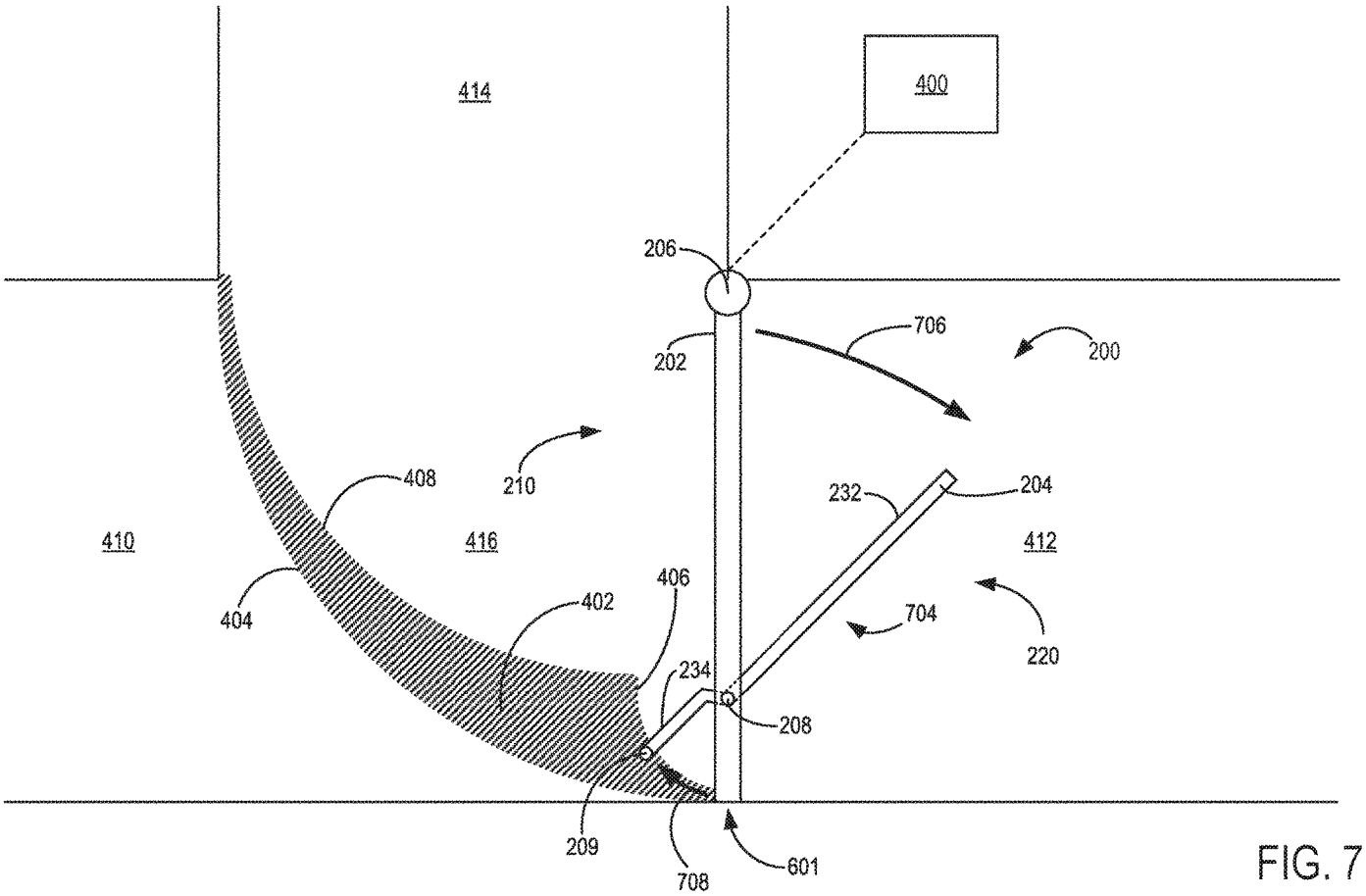
FIG. 7 shows a side view of the door in the active position, with the inner door in a position between fully opened and fully closed.
Figure 8:
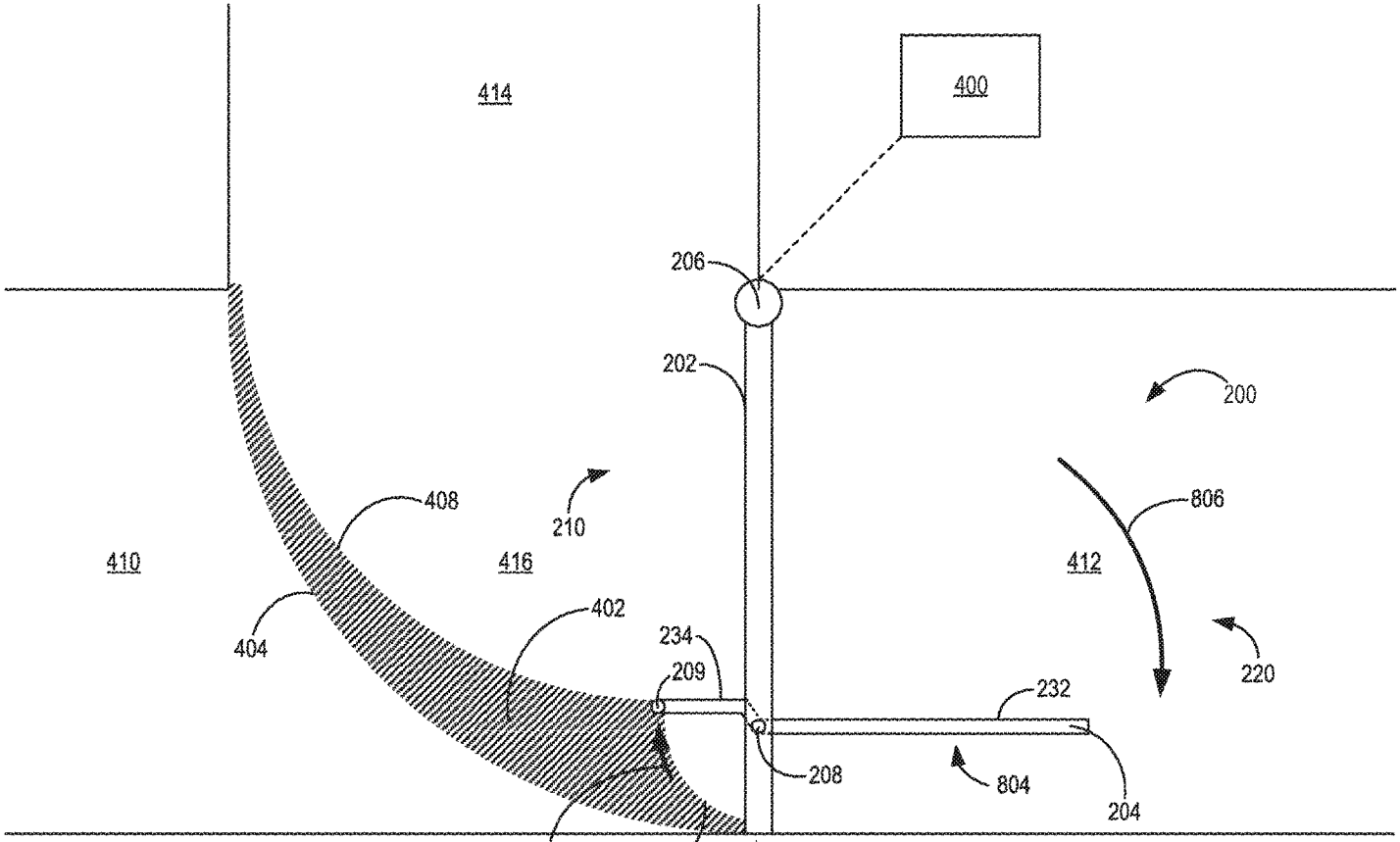
FIG. 8 shows a side view of the door in the active position, with the inner door in the fully opened position.
Figure 9:
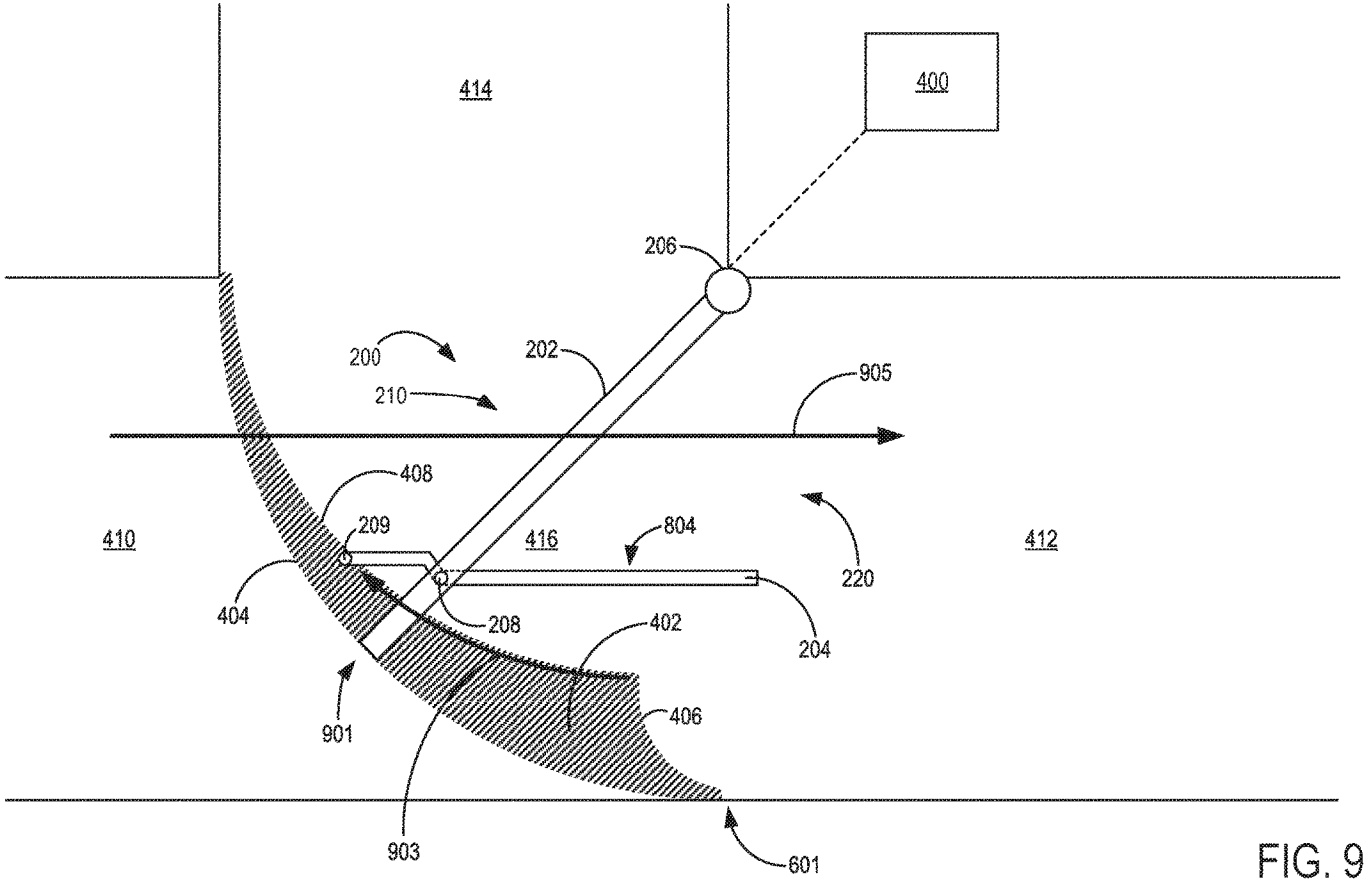
FIG. 9 shows a side view of the door in a position between the active position and the bypass position, with the inner door in the fully opened position.
Figure 10:
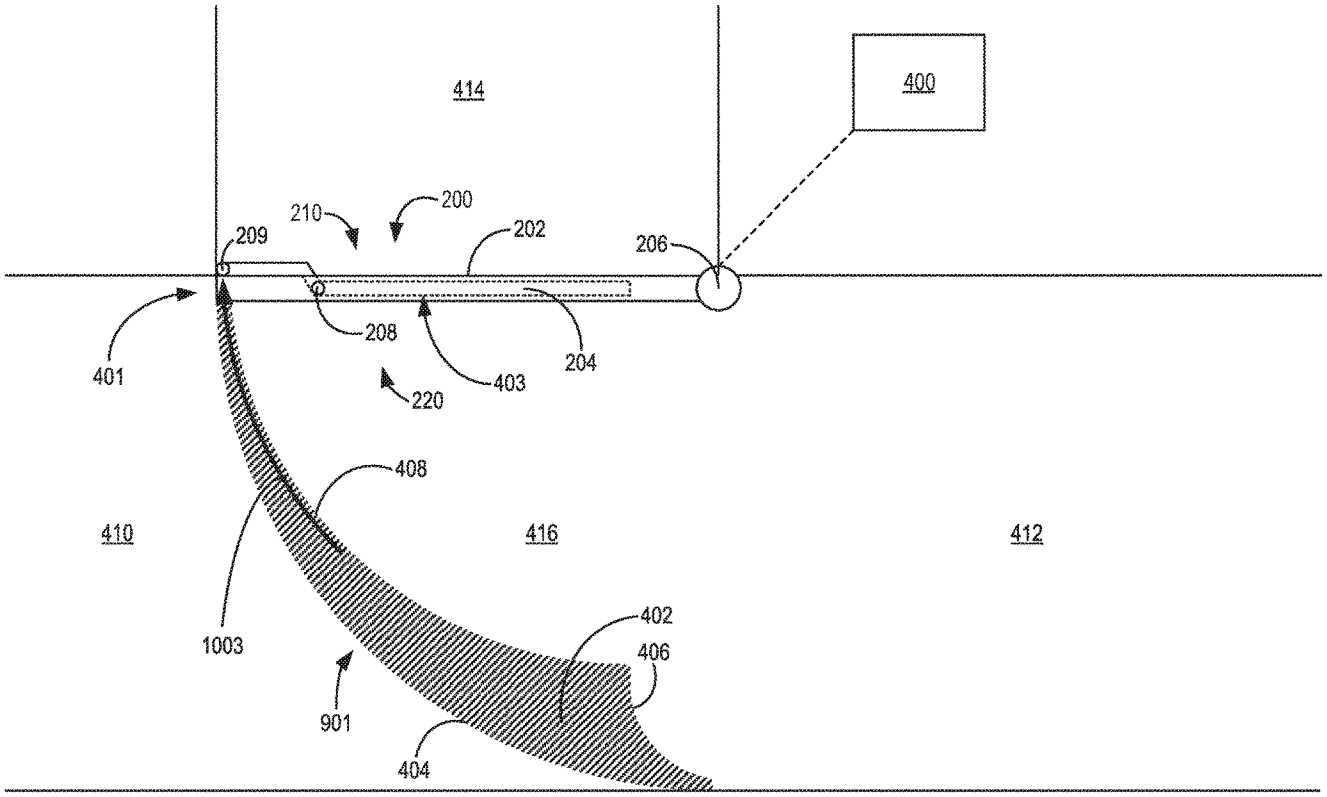
FIG. 10 shows a side view of the door in the bypass position, with the inner door in the fully closed position.

FIGS. 4-10 together show an example operation of the door 200. FIG. 4 shows the door 200 in a bypass position 401, with the inner door 204 in a fully closed position 403 relative to the outer door 202. FIG. 5 shows the door 200 moved from the bypass position 401 to a second position 501 pivoted relative to the bypass position 401, and FIG. 6 shows the door 200 moved from the second position 501 to an active position 601, with each of FIGS. 5-6 showing the inner door 204 in the fully closed position 403 relative to the outer door 202. FIG. 7 shows the inner door 204 moved from the fully closed position 403 to a pivoted position 704 relative to the outer door 202, while FIG. 8 shows the inner door 204 moved from the pivoted position 704 to a fully opened position 804 relative to the outer door 202. The door 200 is then shown by FIG. 9 moved from the active position 601 to a position between the bypass position 401 and the active position 601, with the inner door 204 in the fully opened position 804. FIG. 10 shows the door 200 moved from the position between the bypass position 401 and the active position 601 to the bypass position 401, with the inner door 204 returned to the fully closed position 403.

Turning now to FIG. 4, the door 200 is shown positioned within an example fluid flow system similar to the exhaust system 108 shown by FIG. 1, with a fluid flow junction 416 (which may herein be referred to as exhaust junction 416) positioned between an exhaust passage 410, a bypass passage 412, and an active exhaust passage 414, similar to the first junction 165, exhaust passage 157, bypass passage 163, and active exhaust passage 159 respectively, shown by FIG. 1 and described above. In this position, fluid (e.g., exhaust gas) may flow from a fluid source (e.g., an exhaust manifold, such as the exhaust manifold 148 shown by FIG. 1) through the exhaust passage 410 and into the bypass passage 412. Due to the door 200 being in the bypass position 401, a flow of exhaust gas through the exhaust passage 410 and into the active exhaust passage 414 may be decreased relative to a flow of exhaust gas through the exhaust passage 410 and into the bypass passage 412. In other words, because the door 200 is in the bypass position 401 and the inner door 204 is in the fully closed position 403 relative to the outer door 202, a path of exhaust gas flowing through exhaust passage 410 may be blocked from flowing through active exhaust passage 414.

The door 200 is coupled to a door actuator 400, similar to the door actuator 129 shown by FIG. 1 and described above. The door actuator 400 may pivot the door 200 to a plurality of positions within the junction 416. The junction 416 includes the groove 402 formed within a surface of the junction 416 (e.g., formed by a sidewall of the junction 416). While only one groove 402 is shown by FIGS. 4-10, additional grooves 402 may be positioned within junction 416 so that the guide pin 209 may slide within the grooves 402. The groove 402 includes a first curved surface 404, a second curved surface 406, and a third curved surface 408, with each of the curved surfaces forming an outer perimeter of the groove 402. In one example, a curvature of the second curved surface 406 may be greater than a curvature of the third curved surface 408, and the curvature of the third curved surface 408 may be greater than the curvature of the first curved surface 404. In other words, a radius of curvature relative to locations along the second curved surface 406 may be less than a radius of curvature relative to locations along the third curved surface 408, and the radius of curvature relative to locations along the third curved surface 408 may be less than a radius of curvature relative to locations along the first curved surface 404. In alternate embodiments (not shown), the door 200 may be positioned within a single fluid passage (e.g., exhaust passage) and configured to adjust a flow of fluid (e.g., exhaust gases) through the single exhaust passage by pivoting into a plurality of positions within the single fluid passage. In such embodiments, the groove may be positioned within the single fluid passage.

The groove 402 is configured such that when the door 200 pivots from the bypass position 401 to the second position 501 as shown by FIG. 5, the guide pin 209 of the inner door 204 may slide within the groove 402 along the first curved surface 404 (e.g., along a direction 502). Similarly, as the door 200 pivots from the second position 501 to the active position 601 as shown by FIG. 6, the guide pin 209 continues to slide within the groove 402 along the first curved surface 404 (e.g., along a direction 602) until the guide pin reaches a location where the first curved surface 404 is joined with the second curved surface 406.

With the door 200 in the active position 601 as shown by FIG. 6, a flow of exhaust gas through exhaust passage 410 toward active exhaust passage 414 may be increased, while a flow of exhaust gas through exhaust passage 410 toward bypass passage 412 may be decreased. In one example, exhaust flows through active exhaust passage 414 toward a heat exchanger, such as the heat exchanger 127 shown by FIG. 1. Exhaust may continue to flow from exhaust passage 410 toward active exhaust passage 414 while the door 200 is in active position 601, and the inner door 204 is in the fully closed position 403.

However, as exhaust gas flows from exhaust passage 410 and into active exhaust passage 414, the exhaust gas upstream of the heat exchanger exerts a first pressure on the surfaces of the junction 416 and the door 200 (e.g., on the first side 210 of the door 200), while the exhaust gas downstream of the heat exchanger (e.g., the exhaust gas exiting the heat exchanger at a lower temperature than the temperature of exhaust gas entering the heat exchanger) exerts a second pressure on the surfaces of the bypass passage 412 and the second side 220 of the door 200. As an example, during operation of the engine (e.g., engine 123 shown by FIG. 1), when the door 200 is in the active position 601, the first pressure may increase as a result of an impedance to exhaust gas flow caused by the heat exchanger. For example, while exhaust gas may travel from the exhaust manifold of the engine to the exhaust passage 410 with a first speed, the first speed of the exhaust gas is reduced to a second speed as it flows through the heat exchanger. However, a flow rate of exhaust gas from the exhaust manifold to the exhaust passage 410 may remain relatively constant such that the flow rate of exhaust gas to the junction 416 is greater than a flow rate of exhaust gas through the heat exchanger, and so exhaust gas may accumulate within the active exhaust passage 414 and junction 416, thereby increasing the first pressure of the exhaust gas.

When a difference between the first pressure and the second pressure exceeds a threshold difference (e.g., when the first pressure is sufficiently higher than the second pressure), the detent (shown by FIGS. 2-3) of the inner door 204 may decouple from the ball (shown by FIGS. 2-3) of the outer door 202, and the inner door 204 may pivot around second pivot pin 208 relative to the outer door 202. In one example, the threshold difference may be relative to a pressure difference at which engine performance and/or heat exchanger performance is degraded. For example, the threshold difference may correspond to a difference at which components of the exhaust manifold and/or heat exchanger become degraded due to excessive gas pressures. FIG. 7 shows the pivoted position of the inner door 204 relative to the outer door 202, with the first portion 232 of the inner door 204 pivoting in a first direction 706, and the second portion 234 of the inner door 204 pivoting in a second direction 708. When the inner door 204 pivots relative to the outer door 202 as shown by FIG. 7 (e.g., when the pressure difference exceeds the threshold difference), the first pressure at the first side 210 of the door 200 may equilibrate with the second pressure at the second side 220 of the door 200. In other words, by pivoting the inner door 204 according to the example described above, an amount of opening of the aperture 230 (shown by FIG. 2) of the outer door 202 is increased, thereby increasing a flow of exhaust gas from the junction 416 to the bypass passage 412. In this way, the first pressure may decrease while the second pressure may increase, until both of the first pressure and second pressure are approximately equal in magnitude.

As the exhaust gas flows through the door 200 (e.g., through the aperture 230 shown by FIG. 2) due to the pivoting of the inner door 204, the inner door 204 continues to pivot until reaching the fully opened position 804 shown by FIG. 8. As the inner door 204 pivots toward the fully opened position 804, the guide pin 209 slides within the groove 402 in a direction approximately along the second curved surface 406 (e.g., in direction 808) until the guide pin 209 reaches a location where the second curved surface 406 joins with the third curved surface 408. The first portion 232 of the inner door 204 pivots in direction 806 until the inner door 204 is approximately perpendicular with the outer door 202. In this position, the door 200 is in the active position 601, with the inner door 204 in the fully opened position 804 relative to the outer door 202. The inner door 204 does not pivot further relative to the fully opened position 804 due the position of the guide pin 209. In other words, because the guide pin 209 is positioned at the location where the second curved surface 406 joins the third curved surface 408, and because the guide pin 209 slides within the groove 402, the guide pin 209 is unable to pivot further in the direction 808 due to being in face-sharing contact with both of the second curved surface 406 and third curved surface 408. As a result, the first portion 232 of the inner door 204 is unable to pivot further in the direction 806, and the inner door 204 remains in the fully opened position 804 approximately perpendicular with the outer door 202.

As described above, when the inner door 204 is in the fully opened position 804, the flow of exhaust gas from the exhaust passage 410 to bypass passage 412 may be increased. However, the flow of exhaust gas from exhaust passage 410 to bypass passage 412 may be greater when the door 200 is in the bypass position 401 than when the door 200 is in the active position 601 with the inner door 204 in the fully opened position 804. In one example, as a result, if a controller (e.g., controller 112 shown by FIG. 1) determines that engine performance may be increased by increasing the flow of exhaust gas through bypass passage 412, the controller may send an electric signal to the door actuator 400 to cause the door actuator 400 to pivot the door 200 in a direction toward the bypass position 401. For example, the door 200 is shown by FIG. 9 in a third position 901 between the bypass position 401 and the active position 601. As the outer door 202 pivots around the first pivot pin 206 (as described above with reference to FIG. 2), the inner door 204 may remain in a position approximately parallel with its fully opened position 804. In other words, the guide pin 209 may slide within the groove 402 and along the third curved surface 408 (e.g., in a direction 903) to adjust a position of the inner door 204 relative to the outer door 202 such that the inner door 204 remains approximately parallel with a flow direction 905 of exhaust gas from the exhaust passage 410 through the bypass passage 412 as the door 200 is pivoted toward the bypass position 401. When the door 200 is pivoted into the bypass position 401 as shown by FIG. 10, the guide pin 209 of the inner door 204 may slide within the groove 402 and along the third curved surface 408 (e.g., in a direction 1003) to adjust a position of the inner door 204 such that the detent 214 of the inner door 204 may couple with the ball of the outer door 202 to secure the inner door 204 in the position approximately parallel with the outer door 202.

In this way, in one example, by positioning the door 200 within a fluid flow junction (such as junction 416), the controller may send electrical signals to the door actuator 400 to pivot the door 200 in response to engine conditions (e.g., engine load, exhaust flow rate, coolant flow rate, etc.) to adjust the flow of exhaust gas from the exhaust manifold to active exhaust passage 414 and bypass passage 412. In one example, a position sensor (e.g., position sensor 128 shown by FIG. 1) may transmit electrical signals to the controller to indicate a position of the door 200 (e.g., such as bypass position 141 and active position 191 shown by FIG. 1, or a plurality of positions between the bypass position and active position, as shown by FIGS. 4-10). By adjusting the flow of exhaust gas with the door 200, a flow rate of exhaust gas through the heat exchanger may be increased or decreased. Additionally, by coupling the inner door 204 within the outer door 202 and configuring the inner door 204 to be pivotable relative to the outer door 202, the inner door 204 may pivot into an opened position when a difference in pressure between the first side 210 of the door 200 and the second side 220 of the door 200 exceeds the threshold difference. The inner door 204 may pivot in this way as a passive response to the pressure difference exceeding the threshold difference (e.g., without actuation by an actuator coupled to the inner door, without an electric signal sent to the door actuator 400, etc.). By positioning the guide pin 209 of the inner door 204 within the groove 402, the inner door 204 may be retained in a position approximately parallel with a flow of exhaust gases through the exhaust passage 410 to the bypass passage 412 as the door 200 pivots from the active position 601 to the bypass position 401.

The technical effect of retaining the inner door 204 in a position approximately parallel with a flow of exhaust gases through the exhaust passage 410 to the bypass passage 412 is to reduce an amount of impedance to exhaust gas flow resulting from a position of the door 200 (e.g., to increase a flux of exhaust gases through aperture 230). Additionally, the increase in exhaust gas flowing through the door 200 decreases an amount of exhaust gas flowing against the surfaces of the door 200 (e.g., outer surface 236 shown by FIG. 2). Because the door 200 pivots in a direction opposite to a direction of the flow of exhaust gas from the exhaust passage 410 to the bypass passage 412, decreasing the amount of exhaust gas flowing against the surfaces of the door 200 reduces an amount of effort to pivot the door 200 to the bypass position 401. By reducing the amount of effort to pivot the door 200, a door actuator 400 with a smaller size and/or cost may be utilized. By configuring the inner door 204 to pivot automatically (e.g., passively, and without actuation) in response to the pressure difference exceeding the threshold difference, the door 200 may adjust the flow of exhaust gas with fewer actuators, and a likelihood of the door 200 becoming stuck may be decreased.

FIGS. 2-10 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In one embodiment, a door for an engine exhaust system includes: a pivotable outer door coupled to an exhaust passage at a first pivot location; and an inner door positioned within the outer door and pivotable relative to the outer door, with the inner door coupled to the outer door at a second pivot location. In a first example of the door, the first pivot location is positioned at a first end of the outer door. A second example of the door optionally includes the first example, and further includes wherein the second pivot location is positioned along the outer door, between the first end of the outer door and a second end of the outer door. A third example of the door optionally includes one or both of the first and second example, and further includes wherein the second pivot location is positioned closer to the second end of the outer door than the first end of the outer door. A fourth example of the door optionally includes one or more or each of the first through third examples, and further includes wherein the outer door includes an aperture, and wherein a position of the inner door relative to the outer door defines an amount of opening of the aperture. A fifth example of the door optionally includes one or more or each of the first through fourth examples, and further includes a detent formed at a first end of the inner door and a ball coupled to an inner surface of the outer door, wherein the detent is shaped to couple with the ball, and wherein the ball is biased away from the inner surface of the outer door by a biasing member. A sixth example of the door optionally includes one or more or each of the first through fifth examples, and further includes wherein the inner door is positioned approximately parallel to the outer door when the ball is coupled to the detent. A seventh example of the door optionally includes one or more or each of the first through sixth examples, and further includes a first angled surface and a second angled surface formed by the detent, wherein the first angled surface and second angled surface each couple to an end surface of the first end of the inner door and to each other, and wherein the first angled surface and second angled surface are each angled relative to the end surface. An eighth example of the door optionally includes one or more or each of the first through seventh examples, and further includes wherein the first angled surface is angled by a different amount than the second angled surface relative to the end surface. A ninth example of the door optionally includes one or more or each of the first through eighth examples, and further includes wherein a coupling force to couple the detent with the ball is less than a decoupling force to decouple the detent from the ball. A tenth example of the door optionally includes one or more or each of the first through ninth examples, and further includes: a guide pin coupled to a second end of the inner door; and a groove formed by the fluid passage, shaped to couple with the guide pin. An eleventh example of the door optionally includes one or more or each of the first through tenth examples, and further includes wherein the groove includes a plurality of curved surfaces, and wherein a curvature of each curved surface of the plurality of curved surfaces is different from each other curved surface. A twelfth example of the door optionally includes one or more or each of the first through eleventh examples, and further includes wherein the plurality of curved surfaces includes a first curved surface, a second curved surface, and a third curved surface, and wherein a position of the guide pin along the first curved surface defines a fully closed position of the inner door, wherein a position of the guide pin along the second curved surface defines a plurality of positions of the inner door between a fully opened position and the fully closed position, and wherein a position of the guide pin along the third curved surface defines a position of the inner door relative to a direction of fluid flow through the fluid passage.

In one embodiment, a method for a door includes: pivoting an outer door around a first pivot location from a first position to a second position, the second position approximately perpendicular to the first position; and pivoting an inner door positioned within the outer door around a second pivot location relative to the outer door when a fluid pressure difference between a first side and a second side of the door is greater than a threshold fluid pressure difference. In a first example of the method, pivoting the inner door includes decoupling a detent of the inner door from a ball of the outer door, and wherein a portion of the inner door positioned between the second pivot location and the first pivot location pivots from a third position approximately parallel with the outer door to a fourth position approximately perpendicular with the outer door, in a direction away from the first position and second position of the outer door. A second example of the method optionally includes the first example, and further includes sending an electric signal from a controller to an actuator of the outer door to pivot the outer door from the second position to the first position. A third example of the method optionally includes one or both of the first and second examples, and further includes wherein pivoting the outer door from the second position to the first position includes maintaining the inner door in the fourth position, and wherein pivoting the outer door from the second position to the first position couples the detent with the ball.

In one embodiment, an exhaust system for an engine includes: a first exhaust passage; a second exhaust passage and a bypass passage, each coupled to the first exhaust passage at a junction; a door disposed within the junction, the door comprising: an outer door pivotable relative to the junction at a first pivot location; an inner door positioned within the outer door and pivotable relative to the outer door at a second pivot location; and a controller in electronic communication with an actuator of the door; and a plurality of sensors positioned within the exhaust system. In a first example of the exhaust system, the controller includes computer-readable instructions stored in non-transitory memory to adjust a position of the door with the actuator in response to electric signals received from the plurality of sensors. A second example of the exhaust system optionally includes the first example, and further includes a pin coupled to the inner door, wherein the pin is configured to couple with a groove formed within the junction and to slide along the groove, and wherein a position of the pin defines a position of the inner door.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A door, comprising:

a pivotable outer door coupled to a fluid passage at a first pivot location;

a pivotable inner door within the outer door and coupled to the outer door at a second pivot location; and a detent at a first end of the inner door shaped to couple a ball at an inner surface of the outer door, the ball biased away from the inner surface of the outer door by a spring.

2. The door of claim 1, wherein the first pivot location is positioned at a first end of the outer door.

3. The door of claim 2, wherein the second pivot location is positioned along the outer door, between the first end of the outer door and a second end of the outer door.

4. The door of claim 3, wherein the second pivot location is positioned closer to the second end of the outer door than the first end of the outer door.

5. The door of claim 4, wherein the outer door includes an aperture, and wherein a position of the inner door relative to the outer door defines an amount of opening of the aperture.

6. The door of claim 1, wherein the inner door is positioned approximately parallel to the outer door when the ball is coupled to the detent.

7. The door of claim 6, further comprising a first angled surface and a second angled surface formed by the detent, wherein the first angled surface and second angled surface each couple to an end surface of the first end of the inner door and to each other, and wherein the first angled surface and second angled surface are each angled relative to the end surface.

8. The door of claim 7, wherein the first angled surface is angled by a different amount than the second angled surface relative to the end surface.

9. The door of claim 8, wherein a coupling force to couple the detent with the ball is less than a decoupling force to decouple the detent from the ball.

10. The door of claim 1, further comprising:

a guide pin coupled to a second end of the inner door; and a groove formed by the fluid passage, shaped to couple with the guide pin.

11. The door of claim 10, wherein the groove includes a plurality of curved surfaces, and wherein a curvature of each curved surface of the plurality of curved surfaces is different from each other curved surface.

12. The door of claim 11, wherein the plurality of curved surfaces includes a first curved surface, a second curved surface, and a third curved surface, and wherein a position of the guide pin along the first curved surface defines a fully closed position of the inner door, wherein a position of the guide pin along the second curved surface defines a plurality of positions of the inner door between a fully opened position and the fully closed position, and wherein a position of the guide pin along the third curved surface defines a position of the inner door relative to a direction of fluid flow through the fluid passage.

13. A method for a door, comprising:

pivoting an outer door around a first pivot location from a first position to a second position, the second position approximately perpendicular to the first position; and pivoting an inner door positioned within the outer door around a second pivot location relative to the outer door when a fluid pressure difference between a first side and a second side of the door is greater than a threshold fluid pressure difference, wherein pivoting the inner door includes decoupling a detent of the inner door from a ball of the outer door, and wherein a portion of the inner door positioned between the second pivot location and the first pivot location pivots from a third position approximately parallel with the outer door to a fourth position approximately perpendicular with the outer door, in a direction away from the first position and the second position of the outer door.

14. The method of claim 13, further comprising sending an electric signal from a controller to an actuator of the outer door to pivot the outer door from the second position to the first position.

15. The method of claim 14, wherein pivoting the outer door from the second position to the first position includes maintaining the inner door in the fourth position, and wherein pivoting the outer door from the second position to the first position couples the detent with the ball.

16. An exhaust system for an engine, comprising:

a first exhaust passage;

a second exhaust passage and a bypass passage, each coupled to the first exhaust passage at a junction;

a door disposed within the junction, the door comprising:

an outer door pivotable relative to the junction at a first pivot location;

an inner door positioned within the outer door and pivotable relative to the outer door at a second pivot location; and a controller in electronic communication with an actuator of the door; and a plurality of sensors positioned within the exhaust system.

17. The exhaust system of claim 16, wherein the controller includes computer-readable instructions stored in non-transitory memory to adjust a position of the door with the actuator in response to electric signals received from the plurality of sensors.

18. The exhaust system of claim 16, further comprising a pin coupled to the inner door, wherein the pin is configured to couple with a groove formed within the junction and to slide along the groove, and wherein a position of the pin defines a position of the inner door.

* * * * *